US006858998B1

(12) United States Patent
Shenoy et al.

(10) Patent No.: US 6,858,998 B1
(45) Date of Patent: Feb. 22, 2005

(54) VARIABLE-PERIOD UNDULATORS FOR SYNCHROTRON RADIATION

(75) Inventors: Gopal Shenoy, Naperville, IL (US); John Lewellen, Plainfield, IL (US); Deming Shu, Darien, IL (US); Nikolai Vinokurov, Novosibirsk (RU)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 10/653,064

(22) Filed: Sep. 3, 2003

Related U.S. Application Data

(60) Provisional application No. 60/408,221, filed on Sep. 4, 2002.

(51) Int. Cl.[7] ..... H05H 13/04
(52) U.S. Cl. ..... 315/503; 315/501; 372/2
(58) Field of Search ..... 315/503, 501, 315/507, 505, 500; 372/2, 74

(56) References Cited

U.S. PATENT DOCUMENTS 4,461,004 A * 7/1984 Madey ..... 372/2
5,099,175 A * 3/1992 Schlueter et al. ..... 372/2
5,384,794 A * 1/1995 Takanaka ..... 372/2
5,410,558 A * 4/1995 Hackett ..... 372/2
5,483,129 A * 1/1996 Yamamoto ..... 315/503
5,714,850 A * 2/1998 Kitamura et al. ..... 315/503
6,636,534 B2 * 10/2003 Madey et al. ..... 372/2

* cited by examiner

*Primary Examiner*—Don Wong
*Assistant Examiner*—Ephrem Alemu
(74) *Attorney, Agent, or Firm*—Bradley W. Smith; Mark P. Dvorscak; Paul A. Gottlieb

(57) ABSTRACT

A new and improved undulator design is provided that enables a variable period length for the production of synchrotron radiation from both medium-energy and high-energy storage rings. The variable period length is achieved using a staggered array of pole pieces made up of high permeability material, permanent magnet material, or an electromagnetic structure. The pole pieces are separated by a variable width space. The sum of the variable width space and the pole width would therefore define the period of the undulator. Features and advantages of the invention include broad photon energy tunability, constant power operation and constant brilliance operation.

10 Claims, 19 Drawing Sheets

(b)

VARIABLE-PERIOD UNDULATORS FOR SYNCHROTRON RADIATION

CROSS REFERENCE TO RELATED APPLICATIONS

The instant application claims priority from provisional application No. 60/408,221, filed Sep. 4, 2002, the disclosure of which is incorporated by reference herein in its entirety.

CONTRACTUAL ORIGIN OF THE INVENTION

The United States Government has rights in this invention pursuant to Contract No. W-31-109-ENG-38 between the United States Government and Argonne National Laboratory.

FIELD OF THE INVENTION

The present invention relates to a novel undulator for use in storage rings, energy recovery linacs (ERLs) and Free Electron Lasers (FELs) that overcomes limitations in current insertion device design and expands their functionality; more particularly to variable-period undulators for the production of synchrotron radiation from both medium-energy and high-energy storage rings.

DESCRIPTION OF THE RELATED ART

In a storage ring, relativistic electrons produce synchrotron radiation with unique spectral and collimating properties when they pass through a magnetic device called an undulator. An undulator produces a periodic transverse magnetic field that undulates the electron beam moving along the undulator axis to produce the desired radiation. Most undulators in use today are based on permanent magnet technology in which the magnetic material is assembled in a variety of geometries to produce periodic magnetic structures. The length of such devices is typically 2–20 meters; however FEL applications will require lengths of over 100 meters.

The main limitation of current undulator devices made up of permanent magnets is their fixed magnetic period. The inability to alter this key device parameter greatly limits the operational modes available with current undulator technology.

A principal object of the present invention is to provide an undulator design that enables a variable period length.

Other objects of the present invention are to provide an undulator design that is substantially without negative effects and that overcomes many of the disadvantages of prior art arrangements.

SUMMARY OF THE INVENTION

In brief, a new undulator design is provided that enables a variable period length for the production of synchrotron radiation from both medium-energy and high-energy storage rings. The variable period length is achieved using a staggered array of pole pieces made up of high permeability material, permanent magnet material, or an electromagnetic structure. The pole pieces are separated by a variable width space. The sum of the variable width space and the pole width would therefore define the period of the undulator.

Features and advantages of the invention include broad photon energy tunability, constant power operation and constant brilliance operation. A mechanical drive apparatus includes a pantograph coupled to the staggered array of pole pieces to provide a parallel motion linkage for period variation, counter-screw motion actuators coupled between selected pair of pole pieces, and a support and guiding structure assembly coupled between the staggered array of pole pieces and the pantograph.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Variable-period undulators are provided for the production of synchrotron radiation both from medium-energy and high-energy storage rings. It is based on a staggered array of magnetic poles placed in a magnetic solenoid producing a longitudinal field. The present invention permits variation in the short magnetic period of the undulator by as much as 100%. The unique capabilities of such undulators permits wide tunability based on variation of the period-length, as well as solenoid field. The variable-period undulator device also permits operation at either constant flux or constant power independent of x-ray energy. The variable-period undulator is expected to have a major impact on production and applications of x-rays, especially due to its inherent simplicity and flexibility in design, and absence of radiation damage. Analyses of the magnetic and mechanical design arrangements are presented.

The variable-period undulator extends the capability of a staggered geometry of poles and allows for the first time a concept in which the undulator period can be varied to tune the x-ray energy. The concept is attractive in the design of both short- and long period undulators, due to its simplicity and flexibility, but most importantly its performance can exceed that of permanent magnet undulators. In addition, it is anticipated that the potential new capabilities of the variable period undulator will enhance performance of experiments at the third-generation synchrotron radiation sources, sources based on energy recovery linacs (ERLs), and FELs.

In a planar undulator, the energy harmonics of radiation are produced when the trajectory of the electron beam along the axis of the undulator is modulated by the spatially periodic vertical magnetic field of the undulator. The x-ray energy of the n th harmonic of radiation, En, produced along the axis of the undulator is given by $$E_n(keV)=0.95E^2(GeV)n/(\lambda_u(cm)(1+K^2/2)) \quad (1)$$

In Equation (1), E is the energy of electrons in a storage ring, ERL, or an FEL, n is an odd integer, and $$K=0.934\lambda_u(cm)B_y(T) \quad (2)$$

where $B_y$ is the peak value of the periodic magnetic field in the y direction.

The true limitation of the permanent magnet undulator is that it does not permit its period to be changed, which is a key to energy tunability amongst many other operational capabilities.

Figure 1:
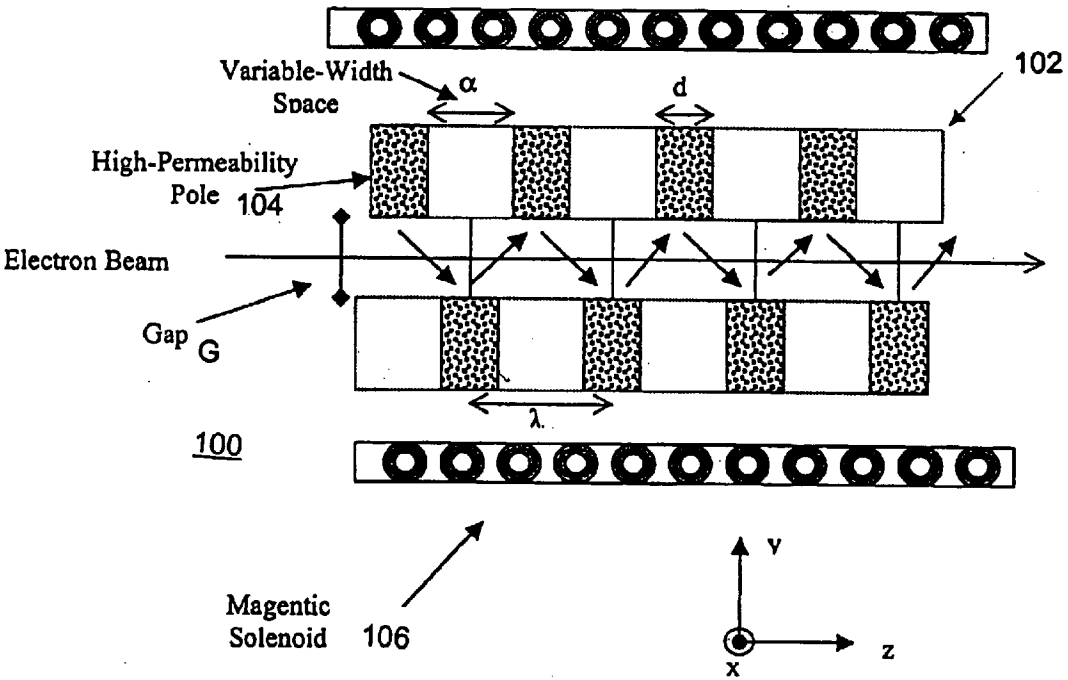
FIG. 1 is schematic and block diagram representation illustrating a variable-period undulator in accordance with the preferred embodiment.

In FIG. 1 illustrates a variable-period undulator 100 in accordance with the preferred embodiment. The period length of variable-period undulator 100 is based upon the use of a staggered array 102 of pole pieces 104 made up of high-permeability rectangular material of width d, separated by variable width space α, as shown in FIG. 1. The set of arrays 102 are placed in a solenoid 106 that produces a uniform longitudinal magnetic field, $B_0$, and could be an electromagnetic or a superconducting coil. The field $B_0$ is deflected by the pole pieces 104 to generate a periodic transverse field with a period $\lambda_u$. The high-permeability pole material could be 1010 steel or Vanadium-Permendur. The spaces with width a permit period variation along z-axis, and the blocks 104 of high permeability material, for example, 1010 steel or Vanadium-Permendur, have a fixed width d. The periodic transverse undulator field is derived by the staggered arrays from the longitudinal field, $B_0$, produced by the electromagnetic or a superconducting solenoid.

The value of the peak transverse field is approximated by the equation:

$$B_y=(2B_0/\sin h(\pi g/\lambda_u))(\sin \pi f)/\pi f, \quad (3)$$

where g is the gap and $f=\alpha/\lambda_u$. From Equation (3) that increasing either the solenoid field, $B_0$, or reducing the value of the width of space a to zero can increase the value of $B_y$. However, the saturation magnetization of high-permeability poles sets the limit on $B_y$. We present the Poisson analysis in the next section in order to fully evaluate the problem in selecting both α and $B_0$.

The solution to Poisson's equations for a defined geometry of the undulator structure gives considerable insight into the magnetic and mechanical performance of the device. Here we only present a summary of 2-D analysis of the magnetic performance of a variable-period undulator using a POISON/SUPERFISH code. It should first be recognized that, as in permanent magnet hybrid undulators, the maximum value of $B_y$ is determined by the permeability of the pole material. We will use the high-permeability 1010 steel in our conservative approach to the design (rather than Vanadium-Permendur which will provide 15–20% enhancement in field strength). To demonstrate the behavior two cases have been chosen with minimum period: (I) $\lambda_u$=1.3 cm, and (II) $\lambda_u$=1.5 cm. The optimization of $f=\alpha/\lambda_u$ (where variable-width space α=(u−d)) was performed to arrive at the maximum value of By, and the results are given in the following Table 1. The effective value of K (referred to as $K_{eff}$) is derived from Fourier decomposition of the By field in Equation (2) produced by the staggered poles of the undulator 100.

TABLE 1

Optimized values of f and pole width from Poisson analysis for two cases, and effective value of K ($K_{eff}$).

| Minimum Period $\lambda_u$ in cm | Gap G in cm | Optimized $f = \alpha/\lambda_u$ | Variable-Width Space α in cm | Pole-Width d in cm | $K_{eff}$ |
|---|---|---|---|---|---|
| I 1.3 | 0.5 | 0.615 | 0.53 | 0.77 | 0.62 |
| II 1.5 | 0.6 | 0.564 | 0.37 | 1.13 | 0.67 |

The value of α can be increased, while keeping the gap, G. and the pole width, d, fixed, to realize the magnetic period increase within a single device. The value of a given in Table 1 is taken as the minimum to define the minimum value of the periods. The Poisson analysis of the magnetic performance with increasing period showed that the device behaves as an undulator even when the period is twice the minimum period. It should be noted that the undulator length (L=N×ku) increases along with magnetic period length, since the number of variable-length periods (N) remains the same within a single undulator. The uniform field region of the magnetic solenoid is made long enough to take this into account.

Figure 2:
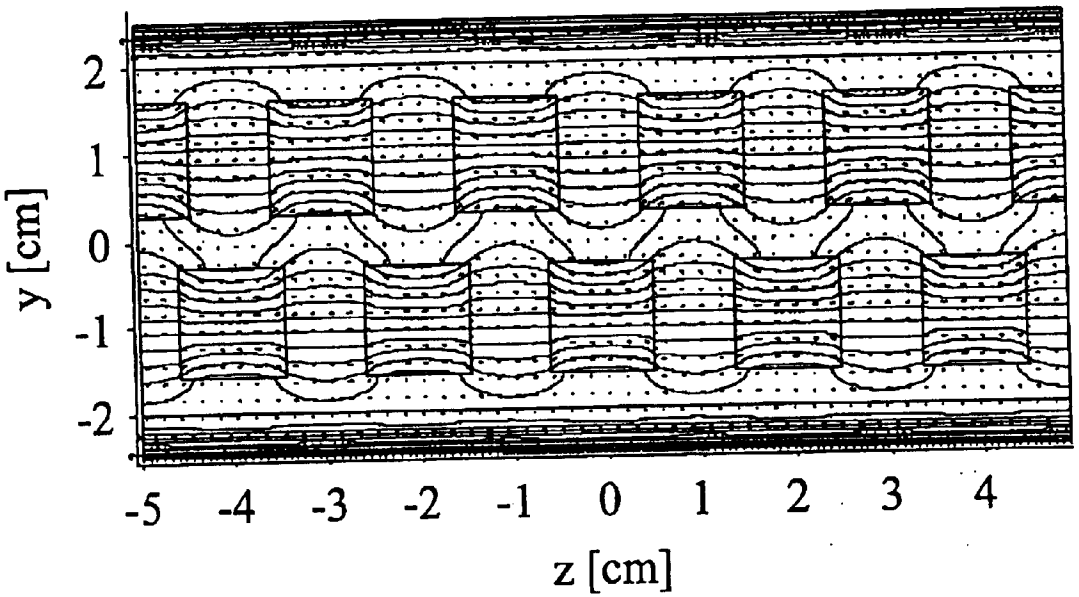
FIG. 2 is a chart illustrating magnetic field profile for an exemplary variable-period undulator of FIG. 1 in accordance with the preferred embodiment.

In FIG. 2, the magnetic field profile for undulatory is shown. The field lines responsible for the undulator behavior of the staggered array configuration rides on a longitudinal field as shown in FIG. 2. The consequences of the longitudinal field are important in the design of the insertion section of the storage ring described below.

As shown in FIG. 2, the magnetic field lines responsible for undulator field ride over a constant longitudinal field throughout the device 100. The illustration is for Undulator II (Table 1) for a period of 2.0 cm.

Figure 3:
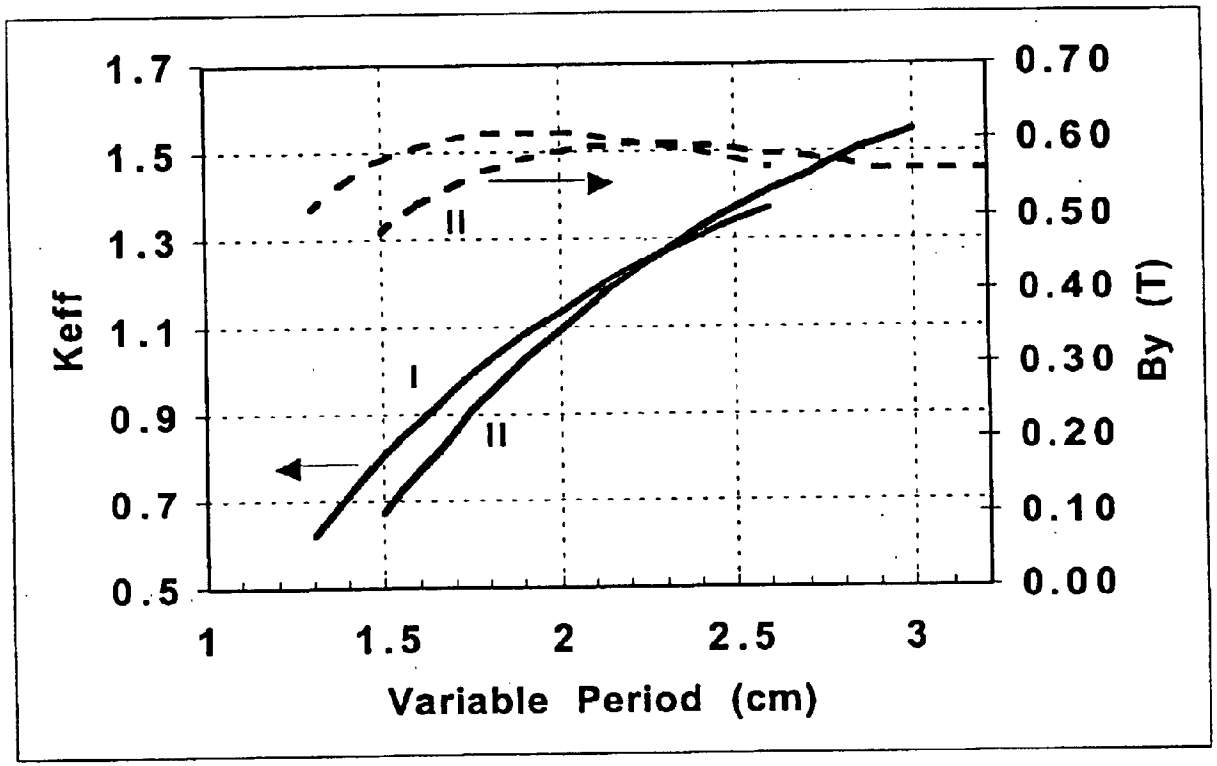
FIG. 3 is a chart illustrating variation of $K_{eff}$ as a function of period length is shown for exemplary variable-period undulators of FIG. 1 in accordance with the preferred embodiment.

In FIG. 3, the variation of $K_{eff}$ as a function of period length is shown for the two devices, Undulator I and Undulator II, 100 of the above Table 1. The values of higher harmonic coefficients of K ($K_3$ and $K_5$) were found to be one to three orders of magnitude smaller than $K_{eff}$ depending on the length of the period. The tunability of harmonics of radiation from these devices based on variable period can be calculated for various electron energies using Equation (1). The dashed lines give the value of By as the period is increased without changing the value of $B_0$(=1.3 T). The value of $K_{eff}$ for any value of the magnetic period, $\lambda_u$, in a device (without changing d, G, or $B_0$) is contributed both by changing values of $\lambda_u$ and $B_y$ (see FIG. 3). Also, the values of $K_{eff}$ are generally small and hence will provide maximum intensity in the first two odd harmonics of radiation. Commensurately, these devices will produce smaller values for the total radiation power. For each value of the variable-undulator period, the value of $B_0$ could be changed to derive additional changes in the value of $K_{eff}$. This adds additional tunability of energy harmonics at each value of the magnetic period. In many respects this is equivalent to varying $K_{eff}$ by changing the gap in permanent magnet undulators. However, in a given permanent magnet device, because of its fixed period, the gap variation is the only path to harmonic tunability.

Figure 4:
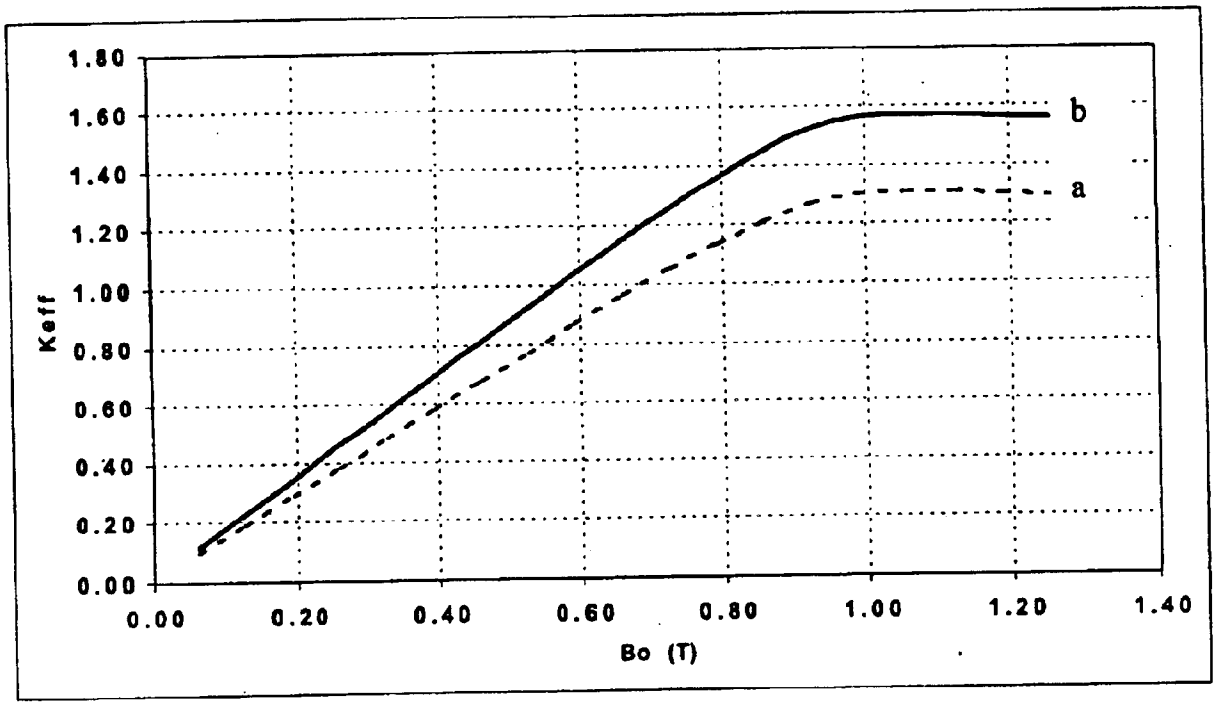
FIG. 4 is a chart illustrating exemplary values of $K_{eff}$ as a function of magnetic field $B_0$ for an exemplary variable-period undulator of FIG. 1 in accordance with the preferred embodiment.

In FIG. 4, values of $K_{eff}$ are shown as a function of $B_0$ for an exemplary variable period undulator 100 at 3.3 cm period. The pole pieces 104 are made of 1010 steel and Vandium-Peremendur. The variation in $K_{eff}$ for a variable-period undulator ($\lambda_u$=3.3 cm, f=0.5 and G=1.15 cm) achieved by changing $B_0$ is shown for (a) 1010 steel and (b) Vanadium-Peremendur poles. The highest value saturates around $K_{eff}$ of 1.5. In hybrid-type permanent magnet undulators such a variation is achieved only through changes in G, and resulting $K_{eff}$ could be larger by nearly a factor of two at small gaps.

In accordance with features of the invention the variable-period undulator 100 provides significant advantages over the traditional permanent magnet undulator.

The design and operational parameters for variable-period undulator 100 span a broad space defined by the length of the period $\lambda_u$, width d of the pole pieces 104, gap G, and solenoid field $B_0$. This is a very rich space that should be explored during the design to meet the specific needs of experiments along with storage ring parameters. Each of these parameters (period $\lambda_u$, width d of the pole pieces 104, gap G, and solenoid field $B_0$) will influence both the performance and tunability, although only the width d of the pole pieces 104 cannot be altered during operation of a device 100. This is in contrast to permanent magnet undulators where only variable available in the operational phase is the gap value. We have pointed out above that the change in $\lambda_u$ and $B_0$ as two key elements in achieving broad variation in $K_{eff}$. Gap variation can also be incorporated in the design, as it is routinely done in hybrid undulators. However, a gap variation may not be necessary in most designs, since its effect on $B_y$ can effectively be mimicked by the variation in $B_0$.

The design performance of the variable-period undulators 100 is demonstrated by choosing two sets of electron orbit parameters representative of high energy (6–8 GeV) and medium energy (2.4–3 GeV) storage rings. The selected parameters for the storage ring and the undulators are given in the following Table 2.

TABLE 2

Electron beam properties used in the calculations to demonstrate the performance through period variation with in a single undulator.

| Properties | Medium Energy | High Energy |
|---|---|---|
| Energy (GeV) | 3.0 | 7.0 |
| Current (mA) | 300 | 100 |
| Beam Size, $\sigma_x$ ($\mu$m) | 91.4 | 254 |
| Beam Divergence, $\sigma_x$ ($\mu$rad) | 25.7 | 15.6 |
| Beam Size, $\sigma_y$ ($\mu$m) | 7.0 | 12 |
| Bean Divergence, $\sigma_y$ ($\mu$rad) | 2.8 | 3.0 |
| Electron Energy Spread ($10^{+3}$) | 1.0 | 1.0 |
| Minimum Undulator Period (cm) | 1.3 | 1.5 |
| Number of Undulator Periods | 80 | 70 |
| Period Increase Factor | 2.0 | 2.0 |
| Approximate Solenoid Length (m) | 2.2 | 2.2 |
| Maximum Solenoid Field (T) | 1.3 | 1.3 |

where the medium energy is taken from DIAMOND design and high energy are current Advanced Photon Source (APS) operational parameters. See Table 1 for details with respect to the above Minimum Undulator Period.

As can be seen from Table 1, the selected undulators 100 will require small gap operation, and hence, in order to avoid small life times for the stored electron beam, it is preferable to operate the storage ring with 'top-up' injection. This has been successfully implemented at the APS and the Swiss Light Source (SLS), and is seriously considered by new facilities under design and construction. The values x-ray beam brilliance, power and power density for various devices are calculated using XOP 2.0 code.

FIGS. 5–8 demonstrate the design performance of the exemplary undulator I operating on a medium-energy storage ring with operational parameters given in Table 2.

FIGS. 9–12 provide the same information for the exemplary undulator II operating on a high-energy storage ring defined in Table 2. The general performance of these devices is superior to that of any permanent magnet undulator covering similar x-ray energy ranges on the selected storage rings. Most notable points from FIGS. 5–12 are the following: (a) the values of $K_{eff}$ are smaller by nearly a factor of two for the variable period undulators compared to hybrid permanent magnet undulators (e.g., Undulator A, currently used at the APS). (b) Brilliance of radiation from the variable period undulators is equal or better than that delivered by comparable permanent magnet undulators (e.g., Undulator A), especially at higher x-ray energies at both medium and high energy storage rings. (c) The new undulators cover a broad tunability range from the first two odd harmonics. (d) The total power from the variable period undulators is lower by nearly a factor of two compared to permanent magnet undulators, while the power density is comparable as expected.

Figure 5:
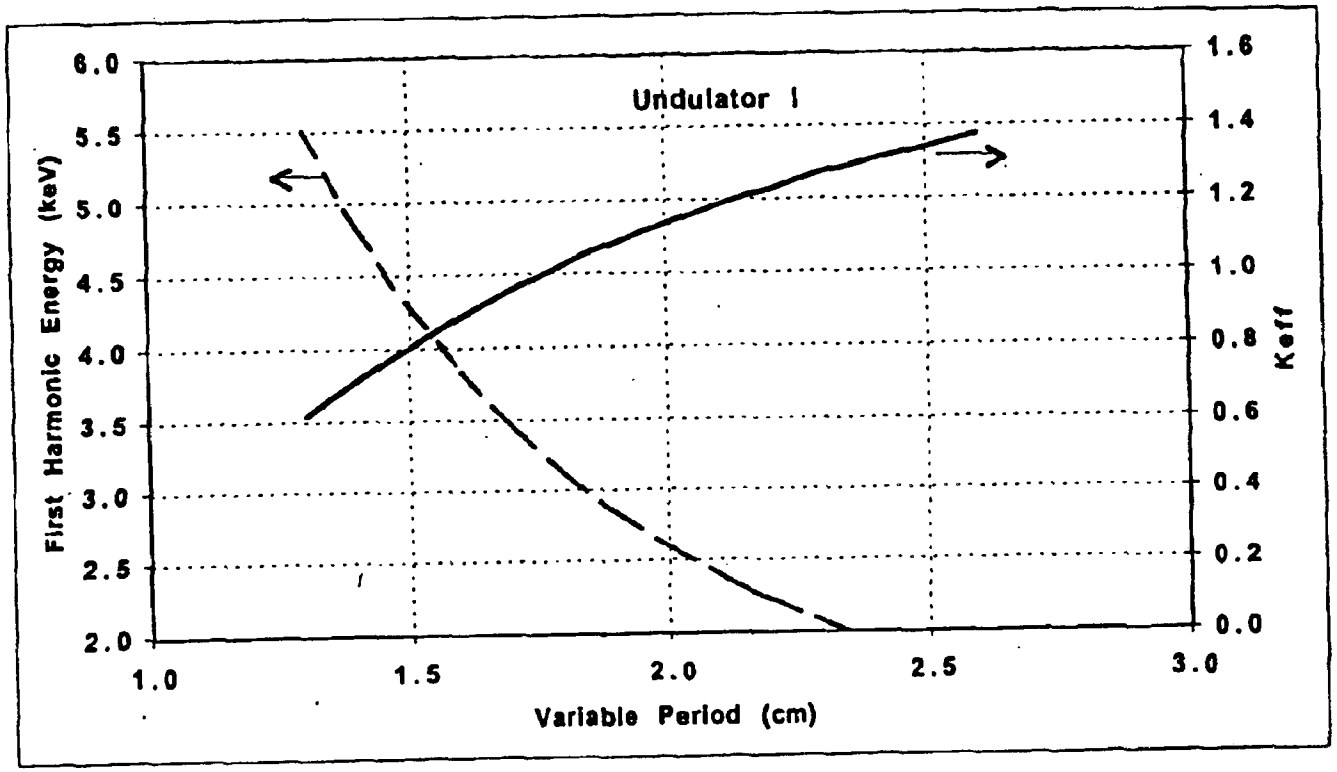
FIG. 5-12 are charts illustrating performance characteristics for exemplary variable-period undulators of FIG. 1 in accordance with the preferred embodiment.

In FIG. 5, variation in the value of $K_{eff}$ and the energy of the first harmonic as a function of changing period of undulator I defined in Table 1 operating on a 3 GeV storage ring (see Table 2).

Figure 6:
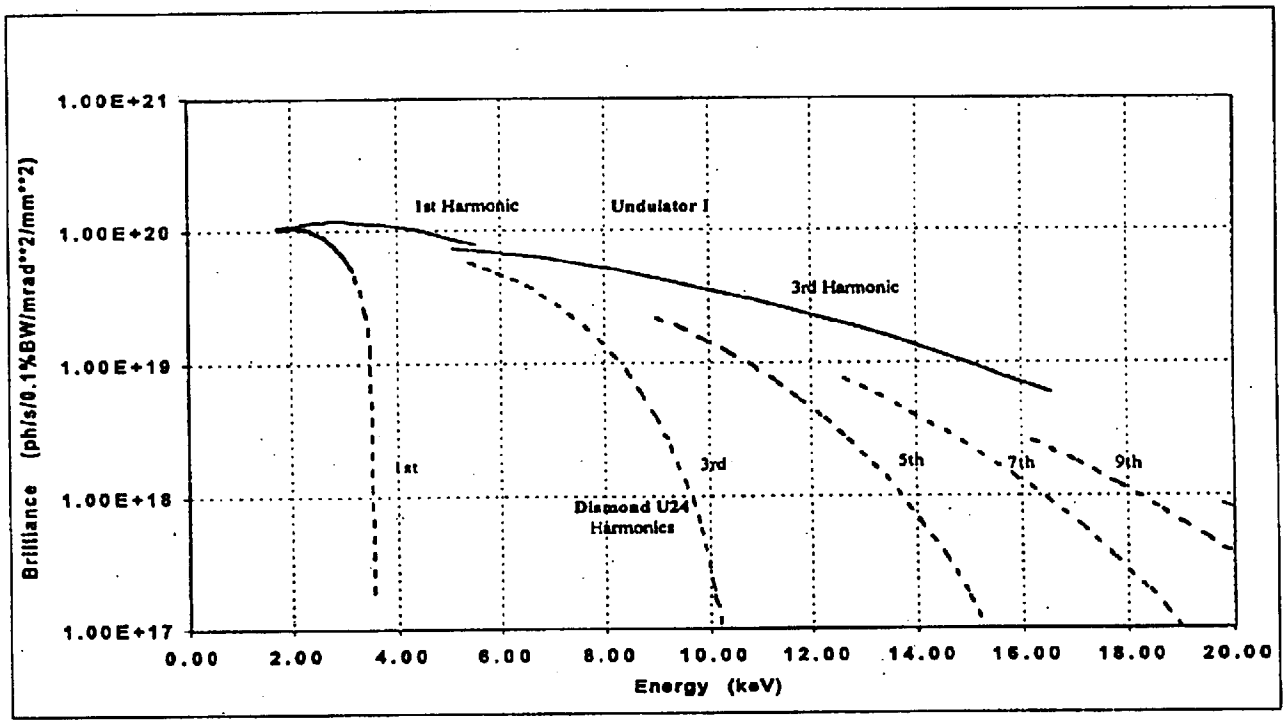

FIG. 6 illustrates values of brilliance of radiation as a function of the energy of first and third harmonics delivered by undulator I defined in Table 1 operating on a 3 GeV storage ring (see Table 2). The performance of Undulator I is compared with that of U24, a 2.4 cm period hybrid permanent magnet undulator, proposed for DIAMOND.

Figure 7:
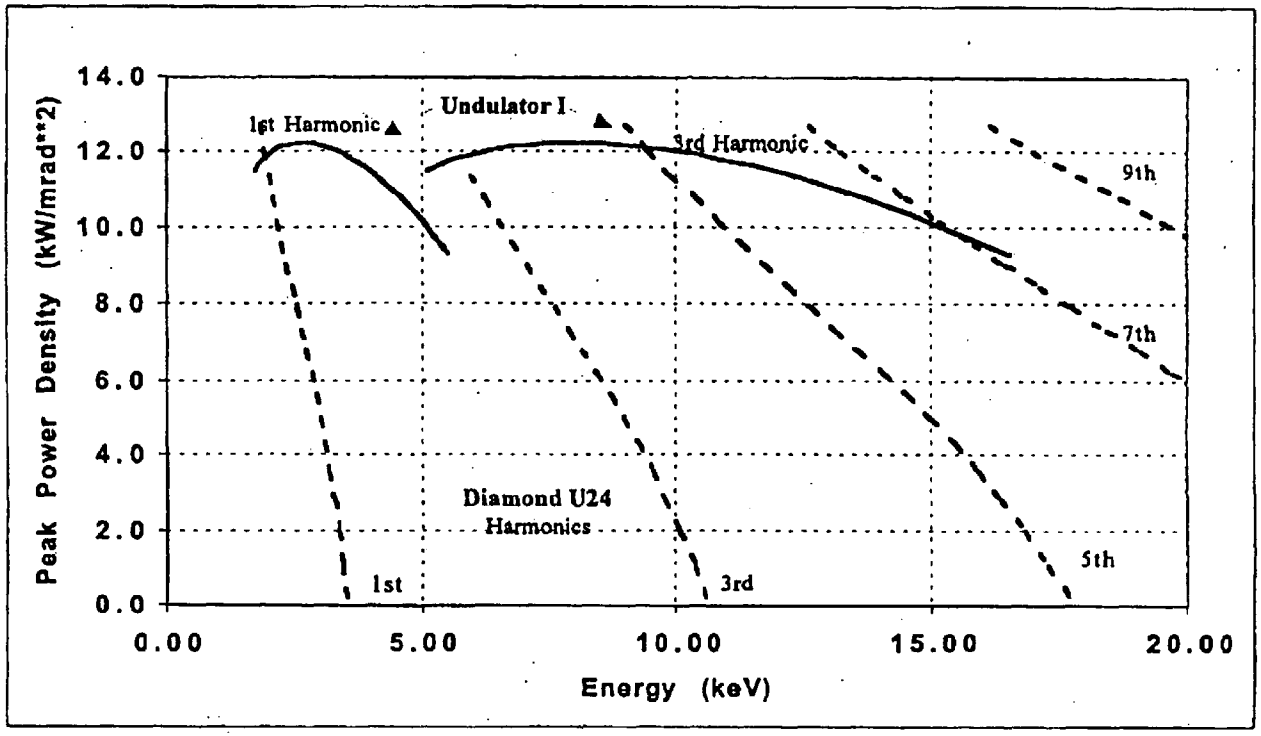

FIG. 7 illustrates values of total power at various energies of first and third harmonics delivered by undulator I defined in Table 1 operating on a 3 GeV storage ring (see Table 2). The performance of Undulator I is compared with that of U24, a 2.4 cm period hybrid permanent magnet undulator.

Figure 8:
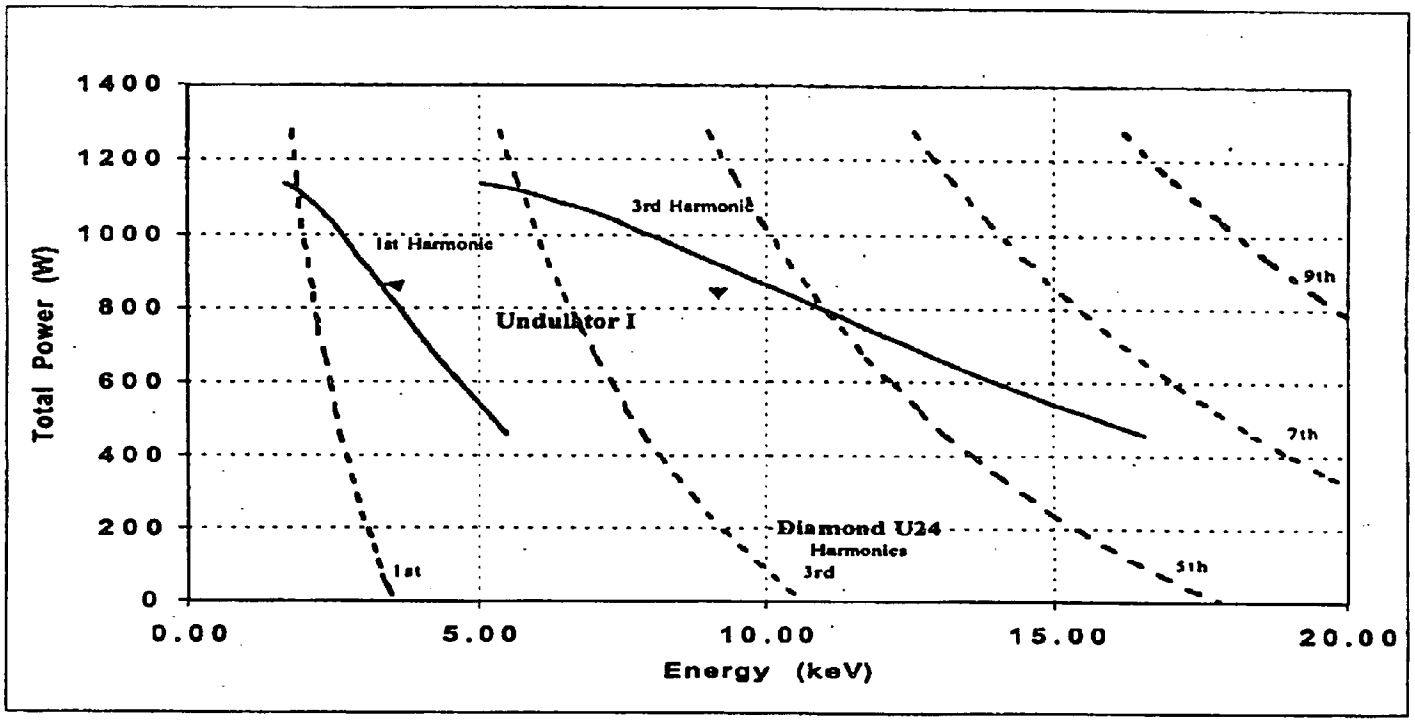

FIG. 8 illustrates values of peak power density at various energies of first and third harmonics delivered by undulator I defined in Table 1 operating on a 3 GeV storage ring (see Table 2). The performance of Undulator I is compared with that of U24, a 2.4 cm period hybrid permanent magnet undulator.

Figure 9:
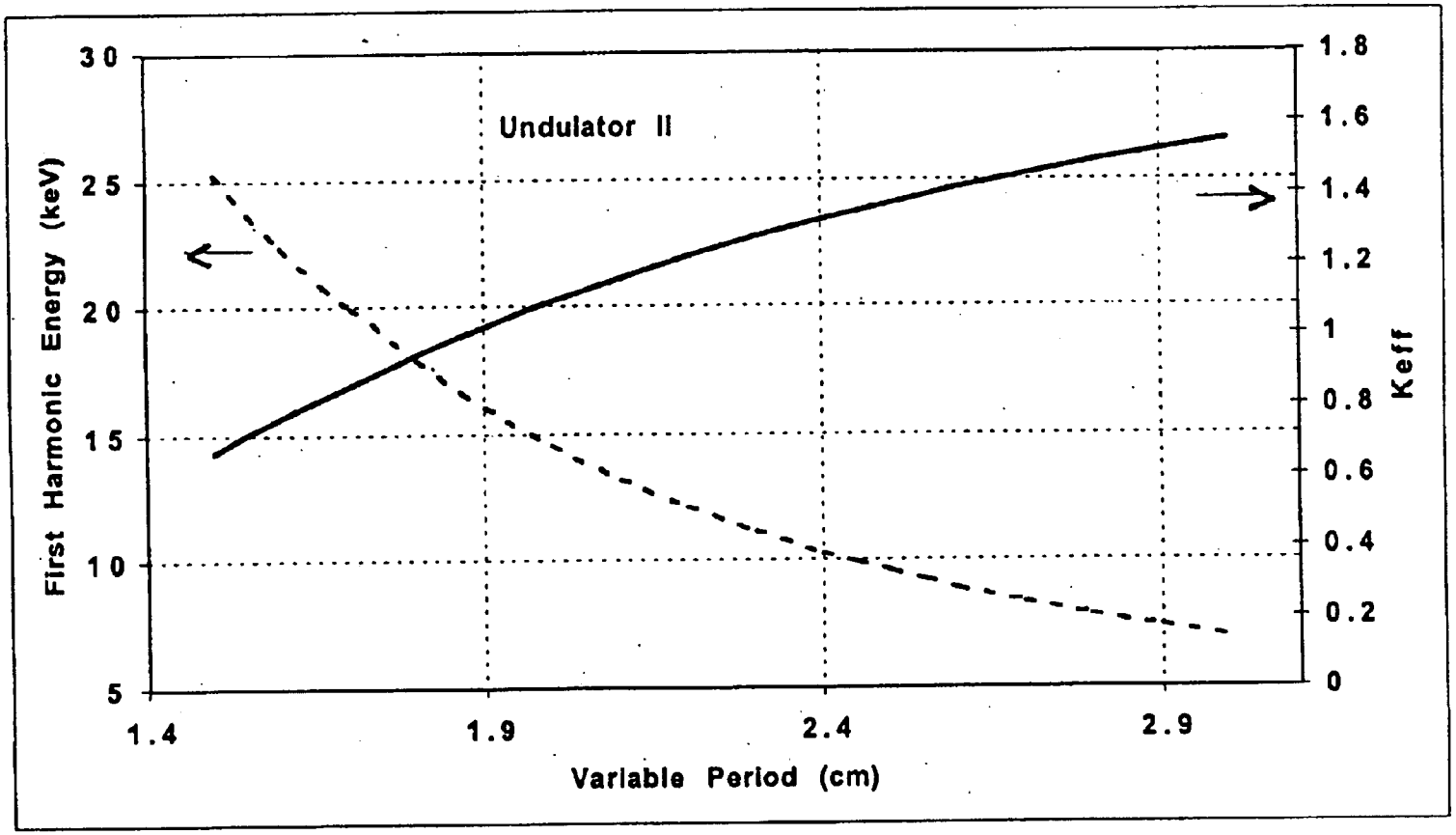

FIG. 9 illustrates variation in the value of $K_{eff}$ and the energy of the first harmonic as a function of changing period of undulator II defined in Table 1 operating on a 7 GeV storage ring (see Table 2).

Figure 10:
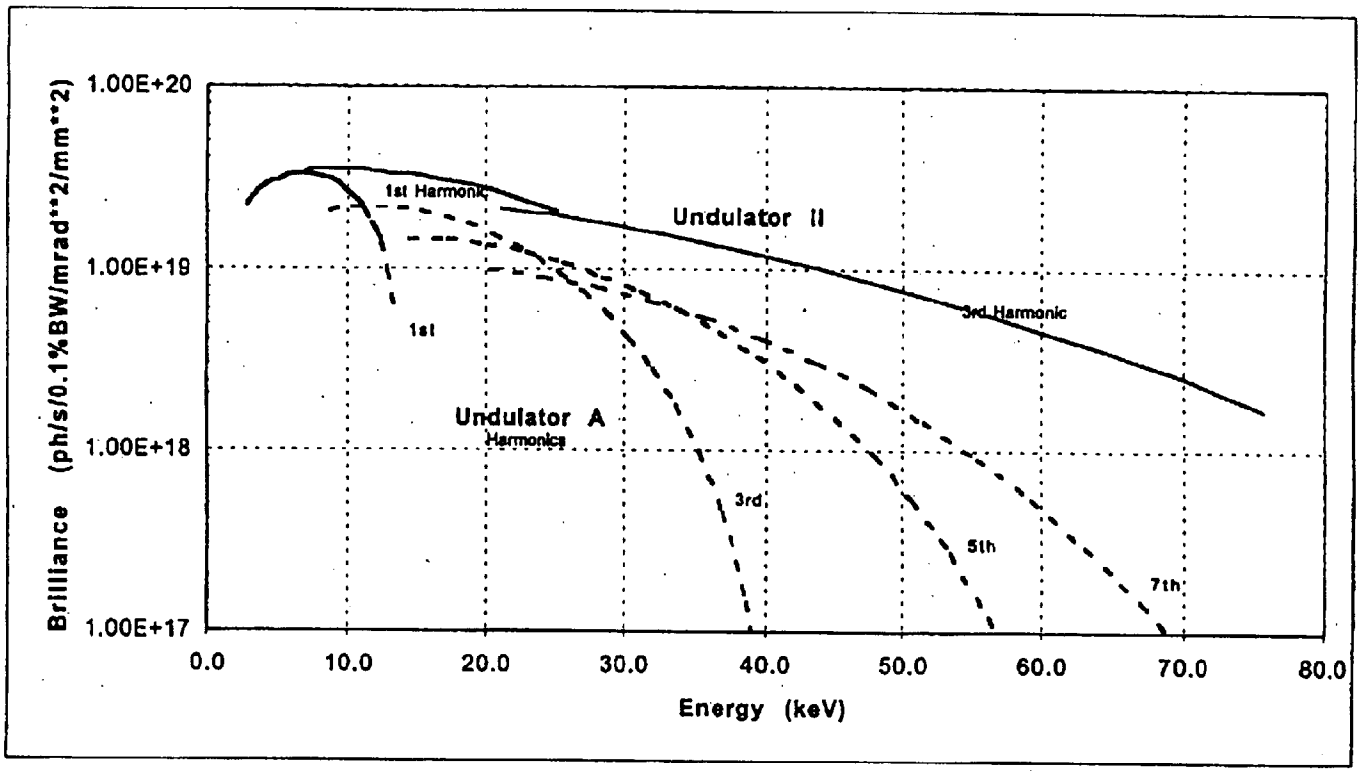

FIG. 10 illustrates values of brilliance of radiation as a function of the energy of first and third harmonics delivered by undulator II defined in Table 1 operating on a 7 GeV storage ring (see Table 2). The performance of Undulator II is compared with that of APS Undulator-A, a 3.3 cm period hybrid permanent magnet undulator at the APS.

Figure 11:
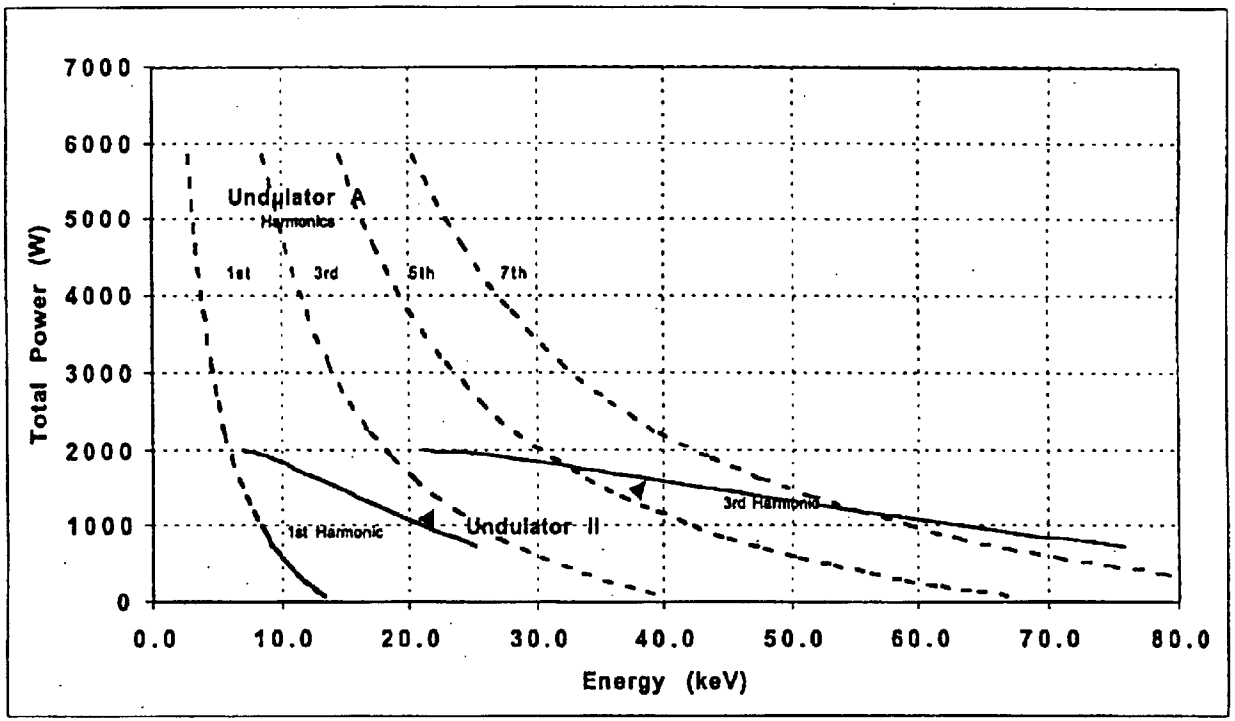

FIG. 11 illustrates values of total power at various energies of first and third harmonics delivered by undulator II defined in Table 1 operating on a 7 GeV storage ring (see Table 2). The performance of Undulator II is compared with that of APS Undulator-A, a 3.3 cm period hybrid permanent magnet undulator at the APS.

Figure 12:
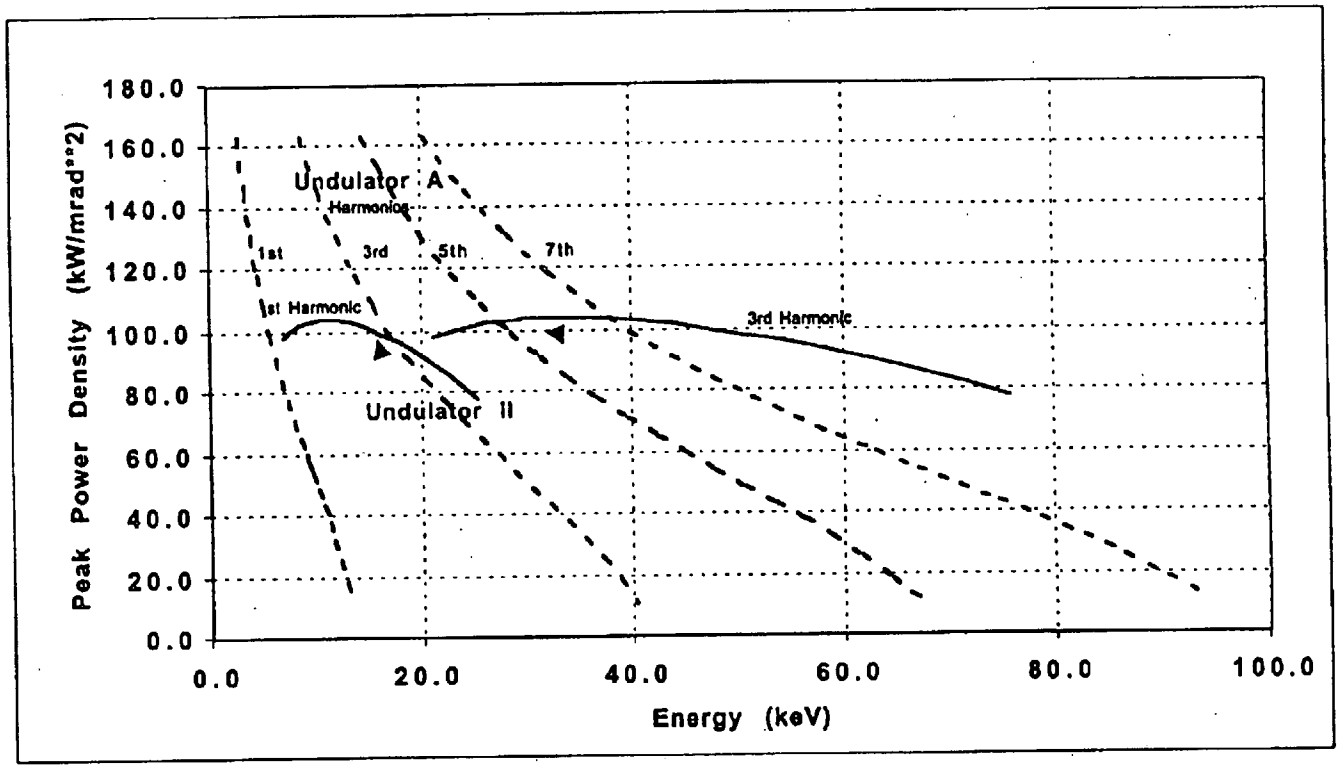

FIG. 12 illustrates values of peak power density at various energies of first and third harmonics delivered by undulator II defined in Table 1 operating on a 7 GeV storage ring (see Table 2). The performance of Undulator II is compared with that of Undulator-A, a 3.3 cm period hybrid permanent magnet undulator at the APS.

Figure 13:
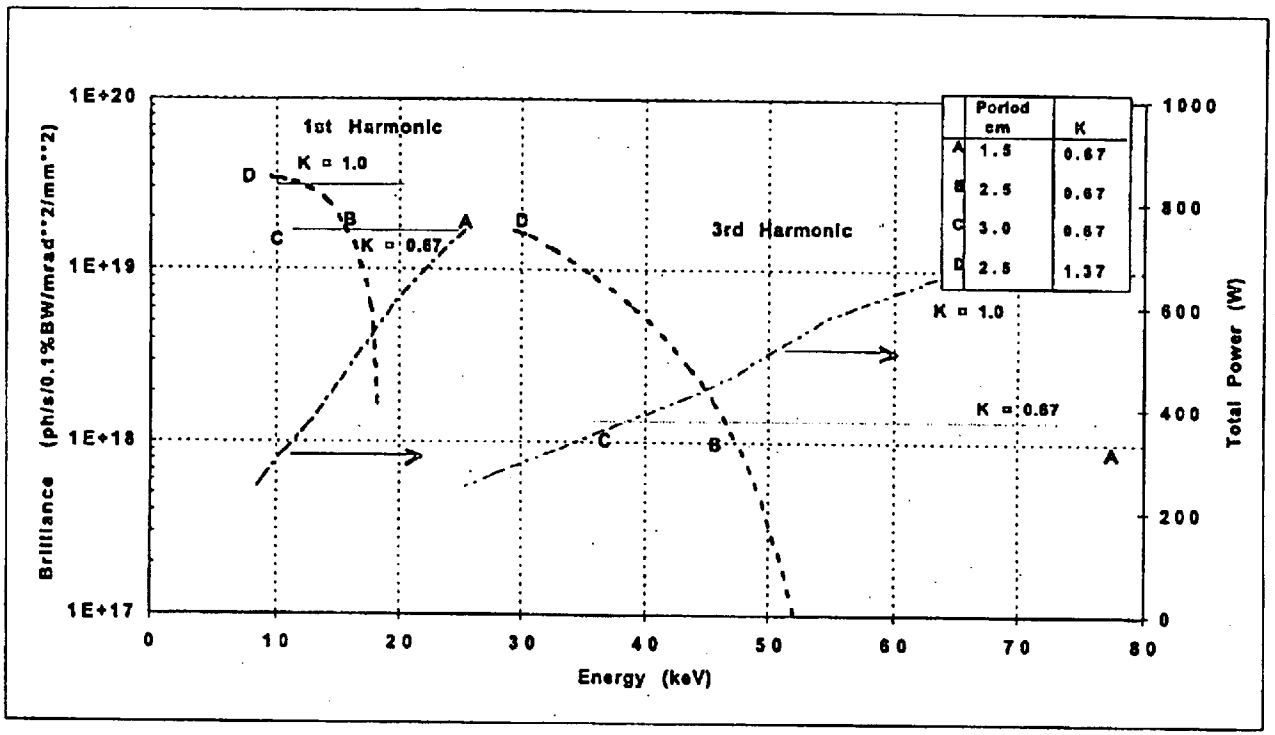
FIG. 13 is a chart illustrates a unique operational mode with a constant or fixed value of $K_{eff}$ of an exemplary variable-period undulator of FIG. 1 in accordance with the preferred embodiment.

FIG. 13 illustrates for the undulator II (Table 1), a unique operational mode for the variable period undulator would be to keep the value of $K_{eff}$ fixed. This produces constant flux (or brilliance for high energy x-rays) from the device delivered to the first optics, which could be very useful for special experiments. This is achieved by reducing the value of $B_0$ (so that $B_y$ decreases) as $\lambda_u$ is increased so as to keep $K_{eff}$ constant (see Equation 2

In FIG. 13, the constant $K_{eff}$ operational mode results in nearly constant brilliance values for undulator II as shown by lines AC for the first and the third harmonics (the period is changed from 1.5 cm to 3.0 cm, see inset). The dashed curves BD are obtained by varying the solenoid field after the period was fixed at 2.5 cm. The total power is linearly proportional to x-ray energy when it is kept fixed as shown by thin dashed lines. The constant values of brilliance for the first and the third harmonics are show by lines AC when the undulator period is changed from its minimum value to double the value. The tunability gap between the first and the third harmonic can be bridged, if desired, by varying the solenoid field (BO) effectively to change $B_y$ at a fixed value of the period. In this demonstration we have chosen to vary Bo after fixing the period at 2.5 cm. This is shown by the curves BD and the resulting values of various parameters are given in the table as an inset in FIG. 13. The value of $B_0$ can be varied for any value of permissible undulator period generating a family of tunability curves of the type BC. The total power from an undulator with N periods can be expressed as:

$$P(W)=7.64NI(A)K_{eff}^2(1+K_{eff}^2/2)E_n(keV)/n, \quad (4)$$

where I is stored current in amperes and En is the energy of the nth harmonic. When Keff is a constant, P will be linearly proportional to the x-ray energy as shown in FIG. 13.

In this example we have demonstrated the flexibility provided by the variable period undulator in tailoring the x-ray beams of constant flux (or brilliance).

Next consider constant power operation. Recently, storage rings are being operated in top up mode in which the stored current is kept constant (e.g. APS, SLS). This operation has provided the ability to deliver constant power to the first optics at specific x-ray energy from an undulator, enhancing the x-ray beam stability in performing the experiment. However, if the experiment requires a change in energy, the gap of the permanent magnet undulator has to be altered, which changes the power load on the first optics. With the flexibility of operation in a variable period undulator, one can overcome this weakness and maintain constant total power at all x-ray energies by adjusting $B_y$ (or $B_0$) at each value of the undulator period. It can be shown that the condition for delivering constant power is that $\lambda_u.B_y^2$ should be a constant. To demonstrate this capability, we will consider a variable period undulator with a minimum period of 2.0 cm and a gap of 0.7 cm optimized for f=0.43.

Figure 14:
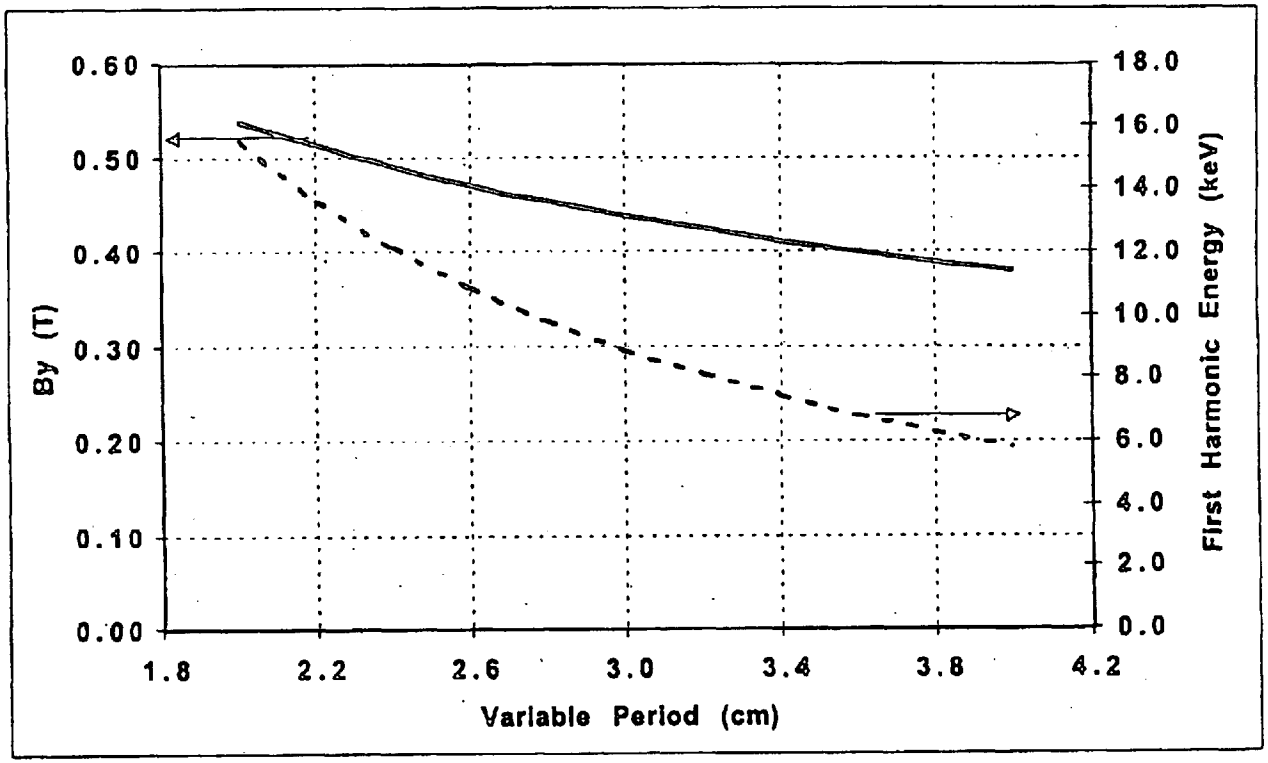
FIG. 14 is a chart illustrates a constant power operational of an exemplary variable-period undulator of FIG. 1 in accordance with the preferred embodiment.

In FIG. 14, values of $B_y$ corresponding to different periods that will generate a constant power when operated on a high-energy storage ring (see Table 2) are shown. The resulting values for the first harmonic energy at different periods are also shown in the graph. The value of the total power from the undulator at all tunable energies is 1.25 kW.

FIG. 14 demonstrats constant power mode of operation of a variable period undulator with a minimum 2.0 cm period operating on the high energy storage ring (Table 2). The values of $B_y$ required to maintain constant power at all x-ray energies is shown as a function of variable period.

Next consider modulating or switching between X-ray energies. There are many experiments with a need to modulate the x-ray energy of the harmonics over a small energy range (e.g., spectroscopies) or switch between two or more fixed energy values (e.g., anomalous scattering, multiple-wavelength anomalous dispersion). This can easily be achieved by superimposing a programmed variable solenoid field on $B_0$ that is phase locked to the experimental equipment (e.g., stepping motors, piezodrivers).

The equivalent of a tapered undulator configuration currently used to increase the energy width of a harmonic can also be realized by superposing a ramped field of appropriate amplitude over $B_0$.

Next consider very long undulators for FEL applications. The undulator based on staggered pole configuration with a fixed period has been successfully used to produce IR radiation from an FEL. With this success, it is natural to think of their applicability for UV and X-ray FELs, which require long undulator lengths. In principle, the new devices can be assembled over very long lengths making them suitable for self-amplified spontaneous emission (SASE) FEL applications with the added bonus of variable-period-length capability and small-gap operation. While this will add tenability to FEL radiation, there are many challenges in accomplishing reliable tuning and reproducibility of the period length.

Next consider new and unique radiation properties. The simplicity of the device design and construction of undulator 100 will lead to new geometrical arrangements and shapes of staggered poles as well as solenoid fields that are capable of producing synchrotron radiation with new properties to meet unanticipated needs of research as well as established needs, such as x-rays with variable polarization.

Optimizing power loads on front ends and optics is now discussed. One of the important considerations for experimenters is to assure that the most of the radiation power is in the harmonic ($P_n$) that is used in comparison to the total power ($P_T$) produced by the undulator. The flexibility in varying the period and the solenoid field, $B_0$, provides a unique opportunity to optimize the ratio $P_n/P_T$. For example, in the illustration discussed above, 56% of power is in the first harmonic and 27% in the third. A variable-period undulator intrinsically being a small $K_{eff}$, device compared to permanent magnet device, truly behaves like an undulator by providing most power to the useful part of the spectrum.

The staggered pole arrays in a variable-period undulator can be placed in ambient pressure surrounding the electron beam vacuum chamber in a straight section of the storage ring or an ERL, or it can be an in-vacuum device sharing the accelerator vacuum since all components are UHV-compatible metals. This might permit smaller undulator gaps (4 mm) if desired. In this case the solenoid will be placed outside the vacuum chamber containing the staggered arrays.

The solenoid 106 could be either an electromagnetic or a superconducting coil. They are relatively simple to build and capable of producing a highly uniform field over the length of the undulator arrays without any shimming. The solenoids are commercially produced to the needed specifications.

The permanent magnet undulators are susceptible to damage from radiation, including bremsstrahlung and beam dumps, as well as synchrotron radiation generated by other magnetic elements in the accelerator upstream of the undulators.

This is particularly serious at small gaps and in-vacuum configurations. The materials in the new undulator 100 of the invention are generally free from such damage issues and hence are suited for small-gap operational needs in storage rings, ERLs, and FELs. In general, installation of an undulator in a storage ring lattice degrades the overall performance of the lattice unless special care is taken in the magnetic design of the undulator. For each storage ring it is hence essential to set limits on undulator magnetic field quality defined by various field integrals such that the undulator is transparent to the electron trajectory. As from any insertion device, the manufacturing errors should be reduced such the measured field integrals meet the specifications. Also, the undulator will contribute to the trajectory kicks as the electron enters and leaves the device. In addition, unlike conventional undulators, a unique aspect of the variable-period undulator is its longitudinal solenoid field, which will produce both focusing of the electron beam and transverse coupling. In the following, we provide a brief summary of these aspects that is considered in the magnetic design.

For an undulator with finite length, it is important to design the end configurations of the magnetic structure to effectively eliminate the trajectory kick for any operational configuration of the undulator, such as value of $B_0$ or the period. A known detailed analysis has focused on such refinements in a fixed-period staggered array undulator. The refinements suggested here to resolve these issues in the present concept for the device include addition of "shielding" blocks at each end of the device, perhaps with slightly different gaps than that for the main staggered arrays. An improved uniformity in the magnetic field profile throughout the solenoid can be achieved by adding end-cap correctors to the solenoid and the transverse coupling is compensated using guard coils.

Figure 15A:
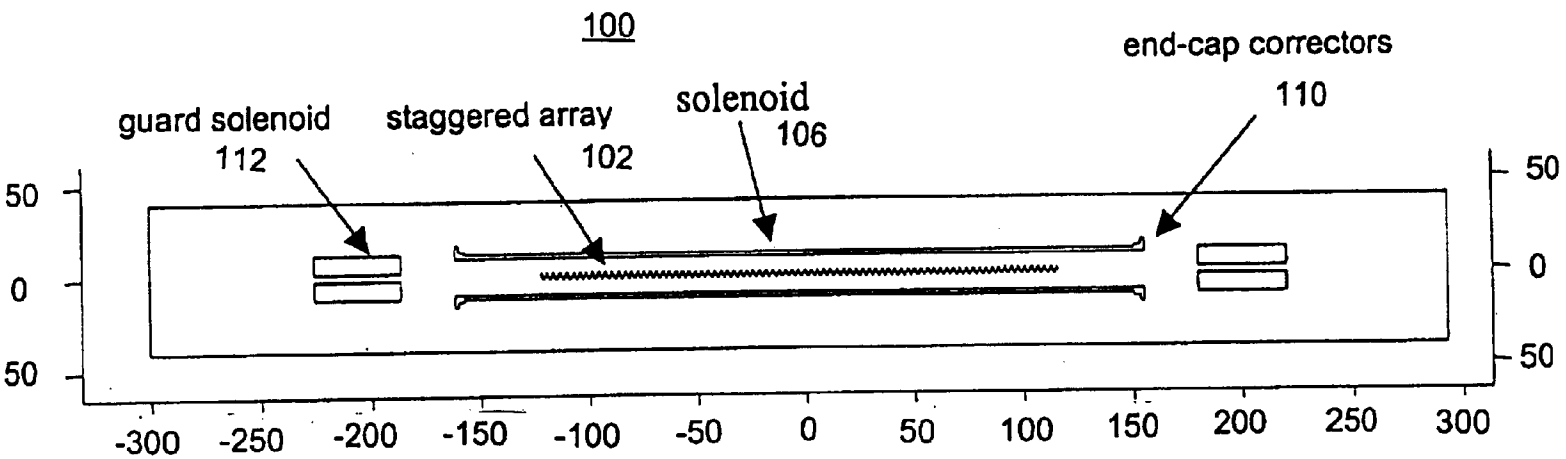
FIGS. 15A and 15B respectively illustrate an exemplary variable-period undulator of FIG. 1 in accordance with the preferred embodiment with end correctors placed in a solenoid with end caps, and guard coils; and magnetic on-axis magnetic field in the z-y plane of an exemplary variable-period undulator of FIG. 1 in accordance with the preferred embodiment.
Figure 15B:
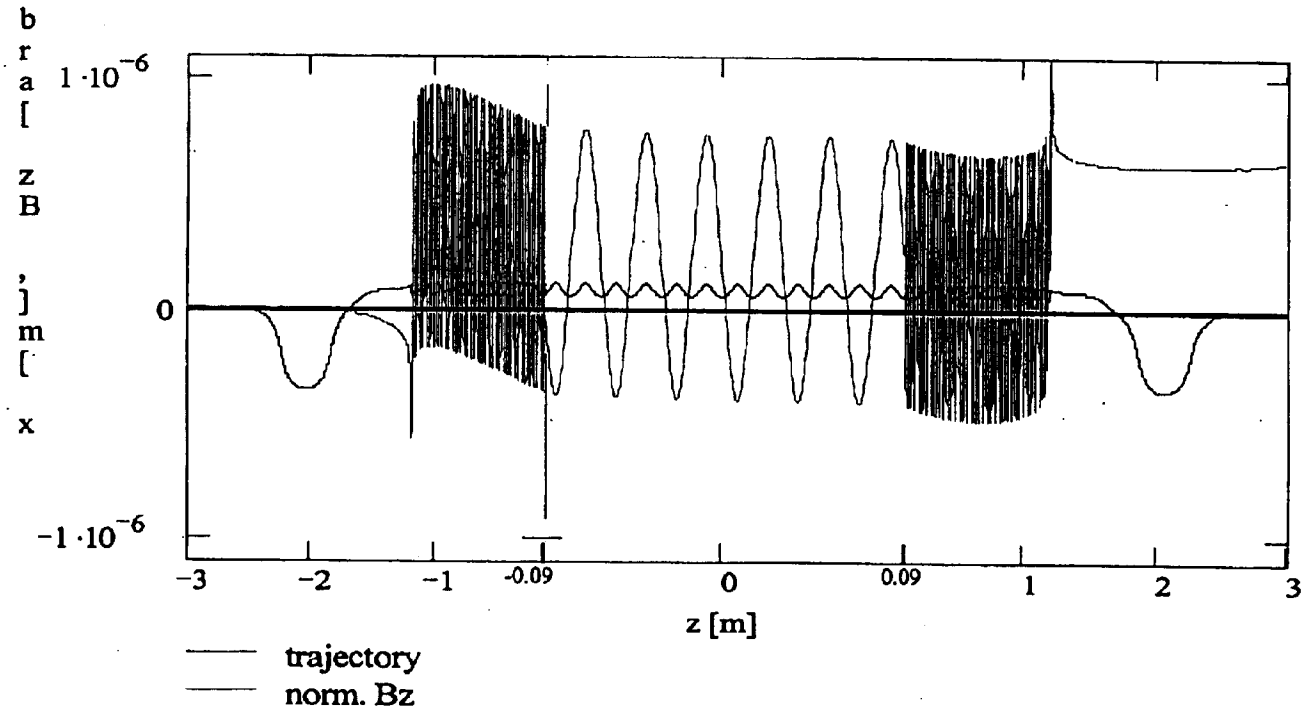

Referring to FIGS. 15A and 15B, FIG. 15A provides a general layout of the variable-period undulator 100 showing the staggered array 102 with end correctors 110 placed in a solenoid 106 with end caps, and guard coils 112 to compensate for transverse coupling. On-axis magnetic field in the z-y plane of Undulator II with 3.0 cm period, K=1.0 and G=6 mm. The 7-GeV electron trajectory in the z-x plane of an 80-period long undulator, with inclusion of end pole configuration, solenoid end-caps 110 and guard coils 112, is shown. The details are shown for six periods in the middle. The variation of the undulator field along the length of 2.4 meter-long device with above refinements is shown in FIG. 15B, along with the trajectory of a 7-GeV electron passing through this undulator with 6 mm gap. The field profile and the trajectory are shown in more detail over a six periods in the middle of the FIG. 15B.

While this modeling requires further refinement, the results are already very satisfactory. All the trajectory errors are well with in acceptable tolerances for the APS.

This analysis has been extended to determine the values of various field integrals and compare them with the acceptable tolerances that will allow one to treat the undulator to be transparent to the motion of the electrons in a third generation storage ring. Since no device has been built, the mechanical design tolerances were assessed from the Poisson analysis by introducing pole placement errors both in the y and z directions. It was determined from this analysis that the first two field integrals for the variable-period undulator with periods of 1.5 cm and 3.0 cm are well within the acceptable specifications for a third generation storage ring like the Advanced Photon Source (APS) even with as large an rms pole placement errors as 100 $\mu$m along both z and y directions. Each pole piece in the new device influences the field of a complete undulator period, and hence the effect of the placement errors is relatively small on the net trajectory through the device. It was also noted in an earlier observation that if the first two field integrals are within the specified budget for a storage ring, the requirements on the multipole tolerances are also satisfied. The details of these requirements should be assessed for each of the storage rings where this new device 100 will be used. While the above analysis shows a weak influence of pole placement error on the electron beam trajectory, its effect is more serious on the radiation properties.

A consideration in the magnetic design of a variable-period undulator is the interaction of the residual longitudinal field along z-direction produced by the solenoid with the electron trajectory. This field will modify the transverse coupling, the strength of which will be determined both by the solenoid field as well as the electron energy. To reduce such coupling to zero, in a linear approximation, the field integral in the z direction should be made zero. There are two possible approaches to achieve this. First, the undulator solenoid inserted in a storage ring straight section is divided into two parts, each part producing equal and opposite ampere-turns and hence providing the necessary cancellation. As a result, the device itself will have two independent sets of staggered pole arrays to provide summed radiation. Second, adding guard coils at the ends of the undulator to generate ampere-turns equal and opposite to the ampere-turns in the undulator solenoid. While this is a simpler geometry, in order to conserve the straight-section length, the guard coils are preferably made out of superconducting wires.

The guard coils will reduce the net transverse beam rotation to less than 7% of the uncompensated value for a 7 GeV electron passing through a 3 m-long solenoid with 0.68 T. The effect of the guard coil field on the electron trajectory in the z-x plane is negligible, as shown in FIG. 15B. The choice of compensation scheme is specific to the storage ring lattice and there are many ways to accomplish the compensation of transverse beam rotation. This is also the case in single-pass accelerators such as ERLs and FELs.

The spectral performance of an undulator is mostly determined by the phase error, which is governed by the pole-to-pole slippage between electron and radiation phases. Preliminary two-dimensional modeling of the device was performed to assess the dependence of phase errors on the pole placement errors in the y- and z-direction. With rms pole placement errors of 25 $\mu$m in both y and z dimensions introduced onto every pole piece, the rms phase error was found to be about 4° and 6° for undulators with 1.5 cm and 3.0 cm period, respectively. A variable-period undulator operates at low $K_{eff}$ values and uses only the first two odd harmonics. The analytical model predicts that the relative intensity of the $n^{th}$ harmonic peak is determined by $e^{-(n\phi)^2}$, where $\phi$ is the phase error. This allows one to accept phase errors larger than those required in permanent magnet undulators which use higher harmonics. The present analysis gives confidence in the undulator spectral performance.

The mechanical tolerances to achieve acceptable values for field integrals and phase errors have been addressed above. It is clear that for the variable-period undulator 100, the largest errors will arise from period-to-period length variations compared to permanent magnet undulators. Thus, the magnet phase error is indeed the correct parameter to be reduced in the design phase. A major focus in the mechanical design of the variable-period undulator 100 is on minimizing the period-length variation along the length of the device, and on maintaining excellent reproducibility of periods while tuning. It is also important to consider various magnetic forces acting within the device in the development of the mechanical design.

A magnetic analysis determined that the forces between the upper and lower staggered arrays of poles in the y direction are weaker by nearly a factor of 2 compared to those in a similar permanent magnet undulator structures. This is expected since the staggered poles do not line up directly above each other. The forces between poles in the z-direction would generally cancel for a perfectly symmetric configuration. Fortunately, the magnetic analysis has shown that even if the deviations of the order of a fraction of a millimeter occur, the resulting forces are of minimal consequence in the design.

All the above considerations have set a global tolerance in the mechanical design of about $\pm 25\mu$ in the placement of poles in the z- and y-directions resulting from various operational configuration of the undulator 100 including the variation in its period. When the undulator period is varied, every pole 104 has to move in unison with each other within above specified tolerances over large linear travel distances. In order to achieve this level of superior mechanical performance, we incorporated three motion controls that assist each other.

Figure 16A:
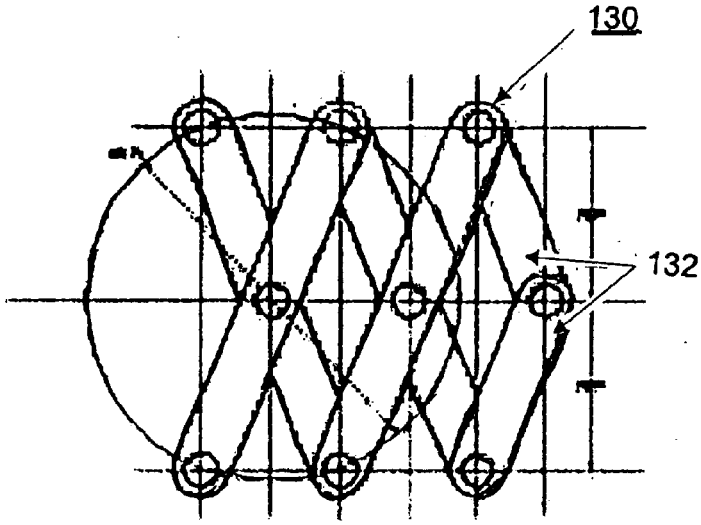
FIGS. 16A, 16B, and 16C are schematic views illustrating respective exemplary components of a mechanical drive apparatus of the variable-period undulator of FIG. 1 in accordance with the preferred embodiment.

Referring to FIGS. 16A, 16B, 16C and 17, a mechanical drive apparatus 120 of the variable-period undulator 100 is shown. In FIG. 16A, there is shown a pantograph 130 that provides the primary motion for period variation. Pantograph 130 includes a framework of jointed rods 132 in a generally parallelogram form. Pantograph 130 is the parallel motion linkage that is used to provide motion along one direction over large distances. While pantographs are easy to build and operate, their capability to provide a motion in unison over the entire structure is limited. They can introduce both cumulative errors and backlash. Hence counter-screw motion actuators 140 illustrated in FIG. 16B have been added to mechanical drive apparatus 120 to establish a natural lock on the entire undulator 100 with very high precision.

Figure 16B:
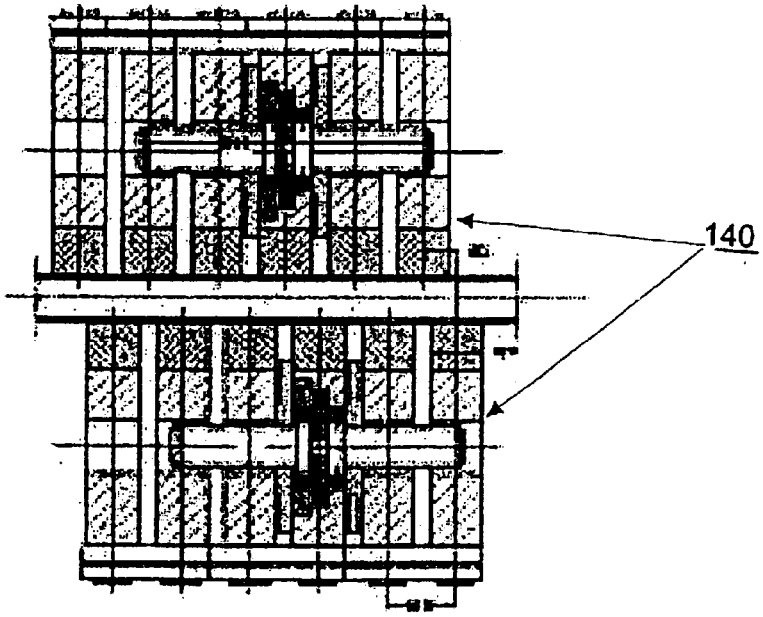

Referring to FIG. 16B, the counter-screw motion actuators 140 are illustrated. In the mechanical drive apparatus 120 such counter screw motion provided by the counter-screw motion actuators 140 may not be required between every pair of poles 104. To balance uneven forces that may develop during the linear motion, constant restoring-force springs are added to the design. The complete mechanical design also includes supporting and guiding structures for the variable-period undulator 100 around the vacuum chamber. The entire assembly 120 must fit inside the solenoid 106. Various configurations could be used for such a supporting and guiding structure assembly.

Figure 16C:
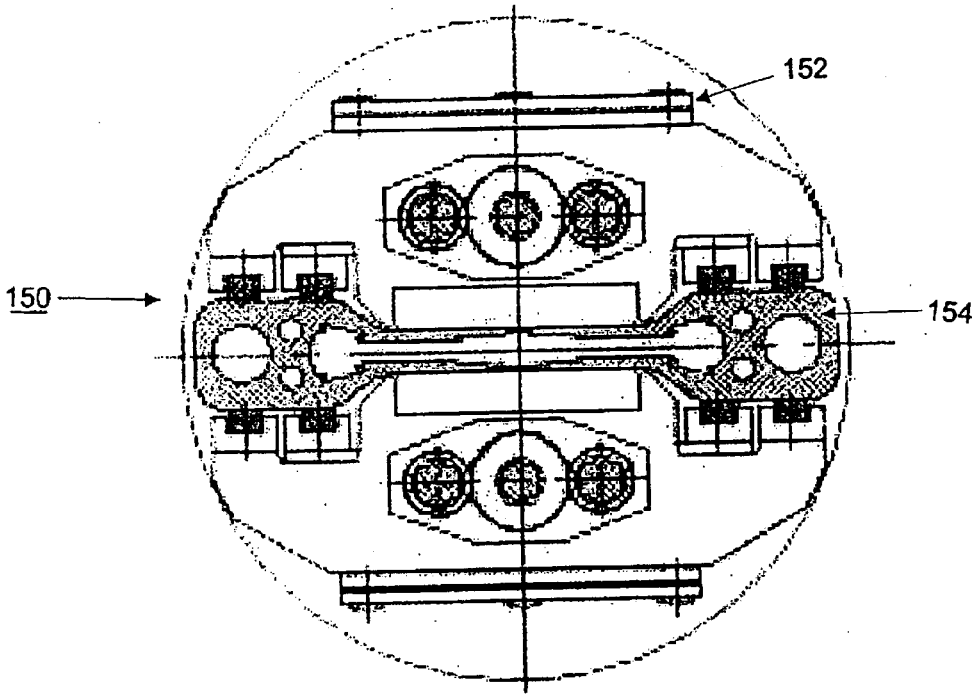

Referring to FIG. 16C, an exemplary supporting and guiding structure assembly 150 is illustrated. Supporting and guiding structure assembly 150 includes a base supporting member 152 and a support arm member 154 coupled between the pantograph 130 and base supporting member 152. In the illustrated supporting and guiding structure assembly 150, the two arrays 102 are independently mounted on the top and the bottom faces of the vacuum chamber. Both the pantograph 130 and counter-screw motion actuators 140 are in the z-x plane.

Figure 17:
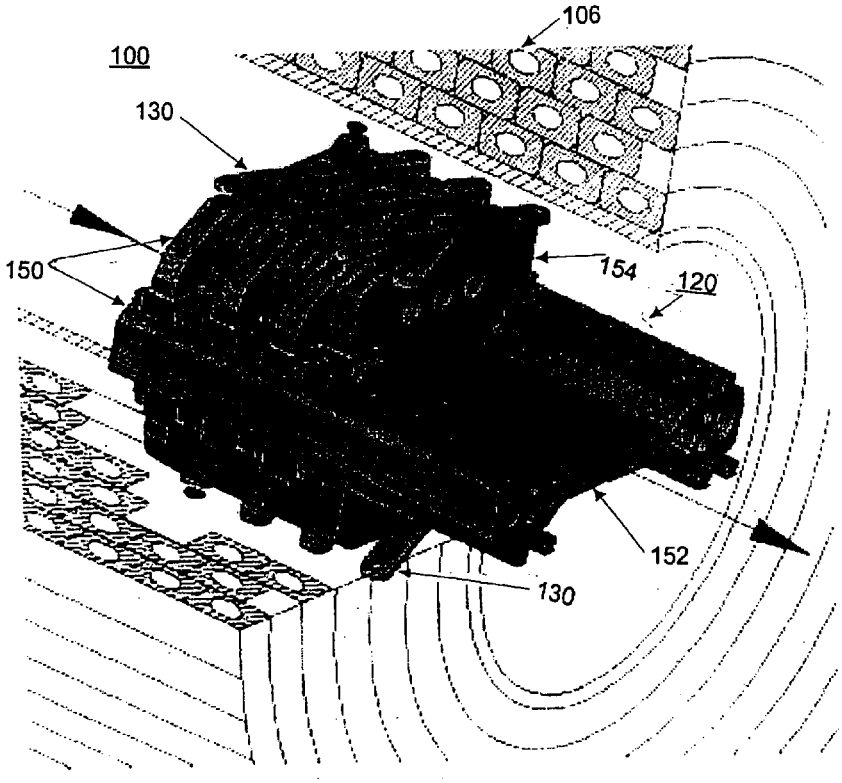
FIG. 17 is a perspective view illustrating a mechanical drive apparatus of the variable-period undulator of FIG. 1 in accordance with the preferred embodiment.

Referring to FIG. 17, there is shown the mechanical drive apparatus 120 including pantographs 130, counter-screw motion actuators 140, and supporting and guiding structure assembly 150 of the variable-period undulator 100. A section of the magnetic solenoid 106 is shown in FIG. 17.

In brief summary, it is demonstrated that the ability to vary the length of the undulator period adds many new capabilities that are beyond those of current undulators operating on third generation synchrotron radiation sources. Variable-period undulator 100 that uses arrays 102 of staggered poles 104 of high permeability material placed inside the magnetic solenoid 106 permits large variation in the undulator period. The detailed magnetic analysis demonstrates the feasibility of the new variable-period undulator 100. The mechanical design of the mechanical drive apparatus 120 is critical to the performance of the variable-period undulator 100. There are no fundamental limitations to build and implement the variable-period undulator 100 either on a third generation storage ring, on an ERL or an FEL.

While the present invention has been described with reference to the details of the embodiments of the invention shown in the drawing, these details are not intended to limit the scope of the invention as claimed in the appended claims.

What is claimed is:

1. A variable-period undulator for the production of synchrotron radiation from both medium-energy and high-energy storage rings comprising:

a staggered array of pole pieces;

said pole pieces being separated by a variable width space;

a sum of said variable width space and a pole width defining the variable-period of the undulator; and a mechanical drive apparatus providing said variable width space.

2. A variable-period undulator as recited in claim 1 wherein said mechanical drive apparatus includes a pantograph coupled to said staggered array of pole pieces providing a parallel motion linkage for period variation.

3. A variable-period undulator as recited in claim 2 wherein said mechanical drive apparatus includes counter-screw motion actuators providing counter-screw motion providing a lock between selected pairs of pole pieces.

4. A variable-period undulator as recited in claim 2 wherein said mechanical drive apparatus includes a supporting and guiding structure assembly coupled between said staggered array of pole pieces and said pantograph.

5. A variable-period undulator as recited in claim 2 wherein said mechanical drive apparatus is positioned within a solenoid; said solenoid producing a longitudinal magnetic field $B_0$.

6. A variable-period undulator as recited in claim 5 wherein said solenoid is one of an electromagnetic coil or a superconducting coil.

7. A variable-period undulator as recited in claim 5 further includes end-cap correctors coupled to said solenoid for providing substantial uniformity in a magnetic field profile throughout said solenoid; and guard coils providing the transverse coupling compensation.

8. A variable-period undulator as recited in claim 1 wherein said pole pieces are formed of a high permeability material.

9. A variable-period undulator as recited in claim 1 wherein said pole pieces are formed of a permanent magnet material.

10. A variable-period undulator as recited in claim 1 wherein said pole pieces are formed of an electromagnetic structure.

* * * * *